US009059572B2

(12) United States Patent
Shibata

(10) Patent No.: US 9,059,572 B2
(45) Date of Patent: Jun. 16, 2015

(54) SPARK PLUG WITH CENTER ELECTRODE FOR INTERNAL COMBUSTION ENGINE

(71) Applicant: DENSO CORPORATION, Kariya, Aichi-pref. (JP)

(72) Inventor: Masamichi Shibata, Toyota (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/519,726

(22) Filed: Oct. 21, 2014

(65) Prior Publication Data

US 2015/0108892 A1 Apr. 23, 2015

(30) Foreign Application Priority Data

Oct. 21, 2013 (JP) ..... 2013-218333

(51) Int. Cl.
*H01T 13/36* (2006.01)
*H01T 13/39* (2006.01)

(52) U.S. Cl.
CPC ..... *H01T 13/39* (2013.01)

(58) Field of Classification Search
CPC ..... H01T 13/38; H01T 13/39; H01T 13/20; H01T 13/14; H01T 21/02
USPC ..... 313/118–143; 445/7
See application file for complete search history.

(56) References Cited

U.S. PATENT DOCUMENTS

| | | | |
|---|---|---|---|
| 5,578,894 | A | 11/1996 | Oshima |
| 2006/0113883 | A1 | 6/2006 | Kanao |
| 2009/0071429 | A1 | 3/2009 | Nakayama et al. |
| 2009/0134764 | A1 | 5/2009 | Kameda et al. |

FOREIGN PATENT DOCUMENTS

| | | |
|---|---|---|
| JP | 5-159853 | 6/1993 |
| JP | 5-242952 | 9/1993 |
| JP | 5-343157 | 12/1993 |
| JP | 2006-156110 | 6/2006 |
| JP | 2009-087923 | 4/2009 |
| WO | WO 2009/084575 | 7/2009 |

*Primary Examiner* — Joseph L Williams
(74) *Attorney, Agent, or Firm* — Nixon & Vanderhye PC

(57) ABSTRACT

A spark plug includes a center electrode, an insulator holding the center electrode inserted thereinto, a housing holding the insulator inserted thereinto and a ground electrode joined to the housing so as to form a spark discharge gap with the center electrode. The center electrode includes a core member and a cover layer covering a surface of the core member. The core member includes a large-diameter portion made of a material having a thermal conductivity higher than that of the cover layer, a small-diameter portion extending from the large-diameter portion toward a distal end side of the core member, and a connecting portion connecting the large-diameter portion to the small-diameter portion. The cover layer is made of a material having a linear expansion coefficient lower than that of the core member, and covers between at least part of the connecting portion and a distal end of the small-diameter portion.

3 Claims, 7 Drawing Sheets

SPARK PLUG WITH CENTER ELECTRODE FOR INTERNAL COMBUSTION ENGINE

This application claims priority to Japanese Patent Application No. 2013-218333 filed on Oct. 21, 2013, the entire contents of which are hereby incorporated by reference.

BACKGROUND OF THE INVENTION

1. Field of the Invention

The present invention relates to a spark plug for an internal combustion engine.

2. Description of Related Art

A vehicle mounted-internal combustion engine is provided with spark plugs as an igniting means. The spark plug includes an insulator holding a center electrode inserted thereinto, a housing holding the distal end portion of the insulator inserted thereinto, and a ground electrode joined to the housing so as to from a spark discharge gap with the center electrode. The spark plug generates a discharge spark between the center electrode and the ground electrode by being applied with a high voltage from an ignition coil to destroy insulation of the spark discharge gap.

Japanese Patent Application Laid-open No. 2006-156110 describes such a spark plug. The spark plug described in this patent document has the structure in which the center electrode is constituted of a core member made of a highly thermal conductive material and a cover layer covering the distal end portion of the core member.

However, this spark plug has a problem as described below.

When the center electrode is heated, the core member expands with heat in the axial direction. At this time, since the proximal end portion of the center electrode is fixed, the distal end of the center electrode moves toward the ground electrode. As a result, since the spark discharge gap between the center electrode and the ground electrode becomes small, the igniting performance of the spark plug is degraded.

SUMMARY

An exemplary embodiment provides a spark plug for an internal combustion engine including:

a center electrode;

an insulator holding the center electrode inserted thereinto;

a housing holding the insulator inserted thereinto in a state that an proximal end portion of the insulator is exposed from the housing; and a ground electrode joined to the housing so as to form a spark discharge gap with the center electrode;

wherein the center electrode includes a core member having a bar shape and a cover layer covering a surface of the core member, the core member includes a large-diameter portion made of a material having a thermal conductivity higher than a thermal conductivity of the cover layer, a small-diameter portion which is smaller in diameter than the large-diameter portion and extends from the large-diameter portion in an axial direction of the core member toward a distal end side of the core member, and a connecting portion formed so as to connect the large-diameter portion to the small-diameter portion, the cover layer is made of a material having a linear expansion coefficient lower than a linear expansion coefficient of the core member, and covers between at least part of the connecting portion and a distal end of the small-diameter portion, and a surface of the large-diameter portion is exposed without being covered by the cover layer.

According to the exemplary embodiment, there is provided a spark plug capable of suppressing thermal expansion of the center electrode thereof to thereby prevent degradation of its ignition performance.

Other advantages and features of the invention will become apparent from the following description including the drawings and claims.

PREFERRED EMBODIMENTS OF THE INVENTION

Figure 1:
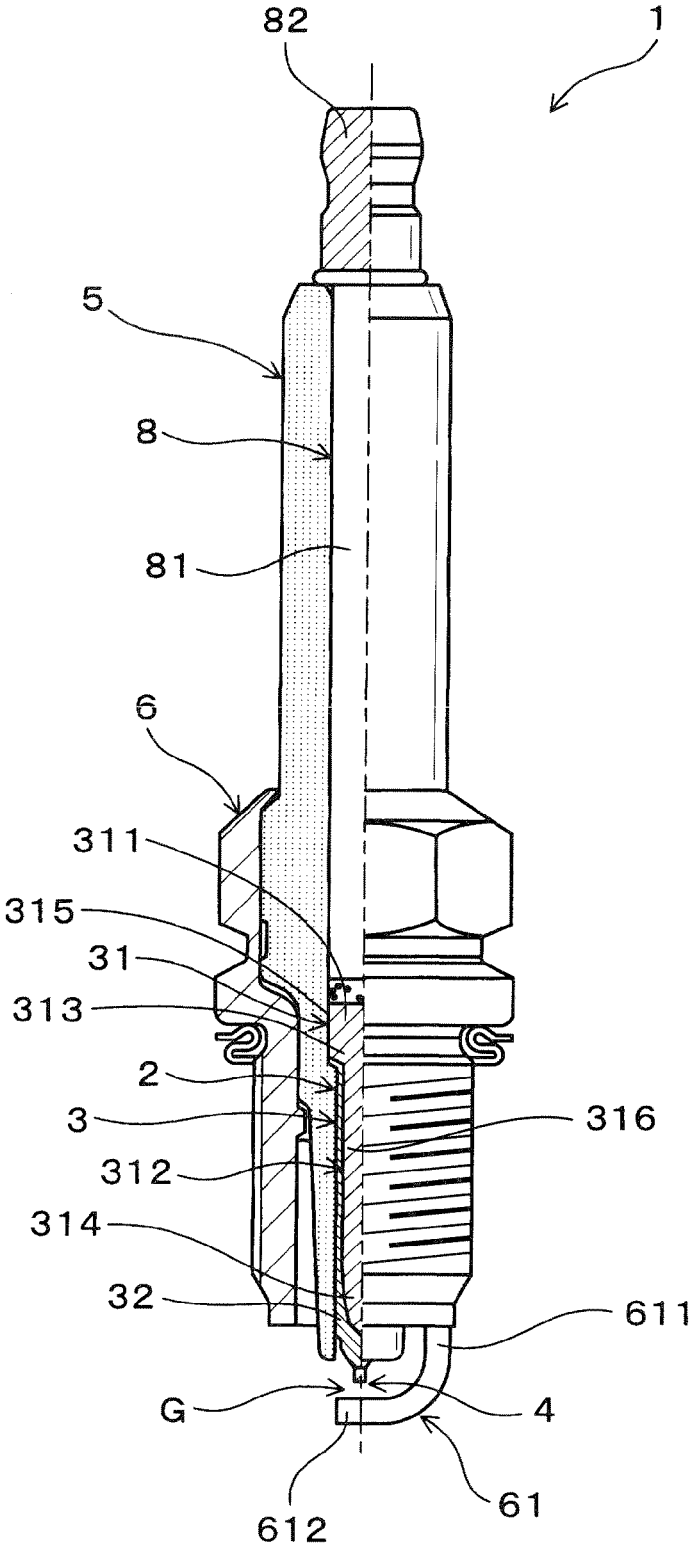
FIG. 1 is a half cross-sectional view of a spark plug according to a first embodiment of the invention.

In the below described embodiments, the same or equivalent parts or portions are indicated by the same reference numerals.

First Embodiment

FIG. 1 is a cross-sectional view of a spark plug 1 according to a first embodiment of the invention. The spark plug 1 includes a center electrode 2, an insulator 5 holding the center electrode 2 inserted thereinto, a housing 6 holding the insulator 5 inserted thereinto in a state of part of the proximal end portion of the insulator 5 being exposed, and a ground electrode 61 joined to the housing 6 so as to form a spark discharge gap G with the center electrode 2. The center electrode 2 includes a core member 31 formed in a bar shape, and a cover layer 32 covering the surface of the core member 31.

The core member 31 includes a large-diameter portion 311 made of a material having a thermal conductivity higher than that of the cover layer 32, a small-diameter portion 312 which is smaller in outer size than the large-diameter portion 311 and extends from the large-diameter portion 311 toward the distal end side, and a connecting portion 313 formed so as to connect the large-diameter portion 311 to the small-diameter portion 312. The cover layer 32 is made of a material having a linear expansion coefficient lower than that of the core member 31, and covers between at least part of the connecting portion 313 and the distal end of the small-diameter portion 312. The surface of the large-diameter portion 311 is exposed without being covered by the cover layer 32.

The spark plug 1 is for igniting a fuel-air mixture within an internal combustion engine (not shown). One end of the spark plug 1 is connected to an ignition coil (not shown). The other end of the spark plug 1 is located in a combustion chamber (not shown) of the internal combustion engine. In the following, the side at which the spark plug 1 is connected to the ignition coil is referred to as the proximal end side, and the side at which the spark plug 1 is located in the combustion chamber is referred to as the distal end side.

The housing 6 has a shape of a cylinder through which the insulator 5 is inserted, and is formed with threads at its lateral periphery to be screwed with the cylinder head (not shown) of the internal combustion engine. The ground electrode 61 is disposed at the distal end surface of the housing 6.

The ground electrode 61 includes an extended portion 611 extending from the distal end surface of the housing 6 toward the distal end side, and an opposed portion 612 extending from the distal end of the extended portion 611 and bent radially inward at a right angle. The spark discharge gap G is formed between the opposed portion 612 and the center electrode 2. The insulator 5 is made of alumina and has a cylindrical shape so as to hold the center electrode 2 and a stem 8 thereinside.

The stem 8 is connected to the ignition coil, and the center electrode 2 is connected to the distal end portion of the stem 8. The stem 8 includes a stem body 81 inserted into the insulator 5 and a terminal 82 exposed outside the insulator 5 and connected to the ignition coil at the proximal end side.

Figure 2:
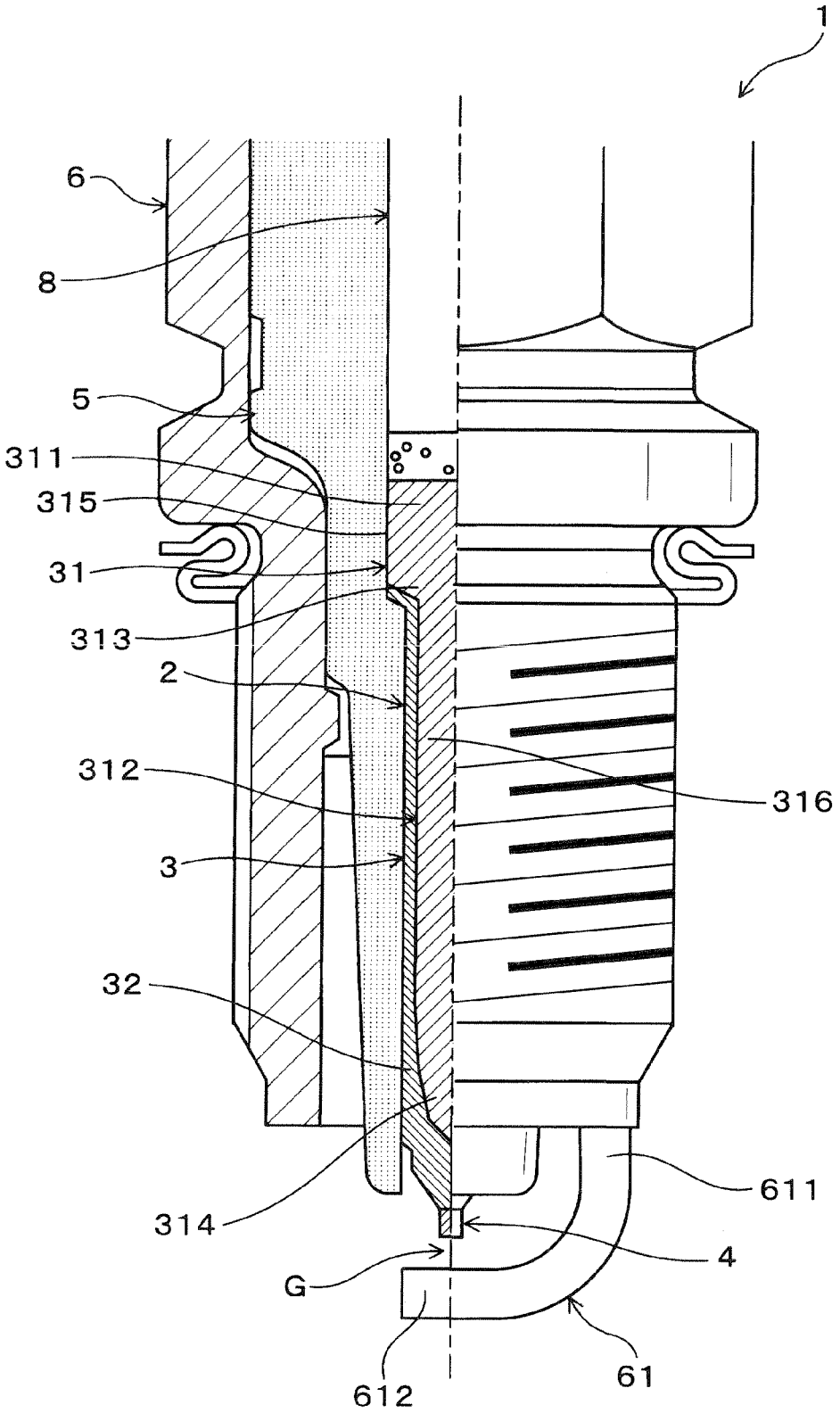
FIG. 2 is a partial enlarged view of FIG. 1.
Figure 3:
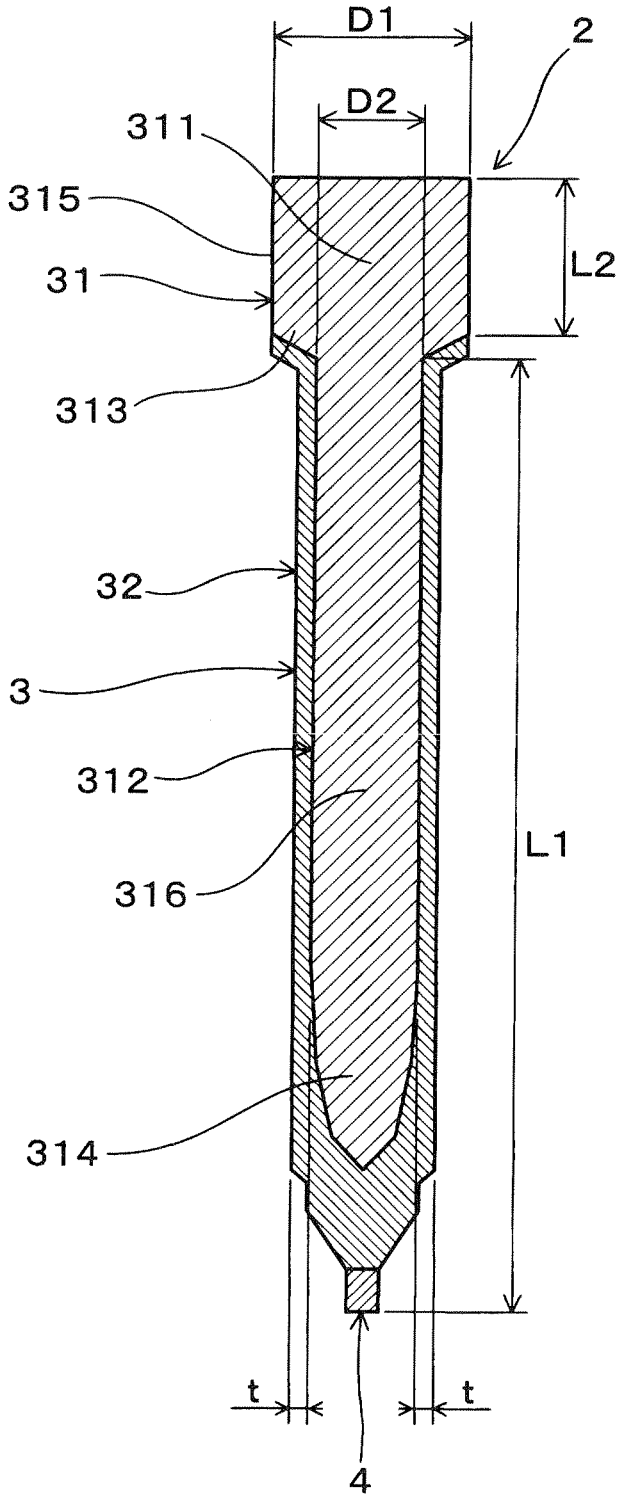
FIG. 3 is a cross-sectional view of a center electrode of the spark plug according to the first embodiment of the invention.

As shown in FIGS. 1 to 3, the center electrode 2 connected to the stem 8 includes an electrode matrix 3 and a discharge chip 4 connected to the distal end of the electrode matrix 3. The electrode matrix 3 includes the columnar core member 31 and the cover layer 32 covering the core member 31. The core member 31 is made of copper alloy the thermal conductivity of which is higher than that of the material of the cover layer 32. The core member 31 includes the columnar large-diameter portion 311 located at the proximal end side, the columnar small-diameter portion 312 which is smaller in outer size than the large-diameter portion 311 when viewed along the axial direction, and the connecting portion 313 having a shape of a circular truncated cone and connecting the large-diameter portion 311 to the small-diameter portion 312. The small-diameter portion 312 includes a small-diameter cylindrical portion 316 formed at the proximal end side thereof, and a reduced diameter portion 314 the diameter of which is reduced in an arc shape toward the distal end side when viewed from the distal end of the small-diameter cylindrical portion 312 along the direction perpendicular to the axial direction.

The cover layer 32 is made of Ni alloy the linear expansion coefficient of which is lower than that of the material of the core member 31, and formed so as to cover the entire surfaces of the small-diameter portion 312 and the connecting portion 313 of the core member 31. The cover layer 32 is formed in a uniform thickness on the entire surfaces of the small-diameter portion 312 and the connecting portion 313. The cover layer 32 is formed also on the outer periphery of the reduced diameter portion 314 such that the outer diameter is reduced gradually toward the distal end side.

The large-diameter portion 311 of the core member 31 is exposed without being formed with the cover layer 32. Since the large-diameter portion 311 has a columnar shape, the outer shape thereof coincides with its circumscribed circle when viewed along the axial direction. The axial dimension of the large-diameter portion 311 is such that the area S1 of the lateral periphery 315 thereof is equal to three times the area S2 of the circumscribed circle.

The discharge chip 4 is welded to the electrode matrix 3 so as to be exposed from the distal end of the insulator 5. In this embodiment, the discharge chip 4 is made of a noble metal such as iridium, platinum or rhodium, or an alloy of them. However, the discharge chip 4 does not necessary have to be made of a noble metal. It may be made of a material having a high melting point such as tungsten, rhenium, tantalum or niobium, or an alloy of them.

The spark plug 1 described above provides the following advantages. Since the cover layer 32 is made of the material the linear expansion coefficient of which is lower than that of the material of the core member 31, the amount of thermal expansion of the cover layer 32 at the time of being heated is smaller than that of the small-diameter portion 312 of the core member 31. Accordingly, the small-diameter portion 312 and the connecting portion 313 are fixed by the cover layer 32 formed surrounding them, and their thermal expansions are suppressed. As a result, the center electrode 2 can be suppressed from expanding in the axial direction to thereby suppress variation in axial length of the spark discharge gap G. Hence, the ignition performance of the spark plug 1 can be suppressed from being degraded.

The large-diameter portion 311 is exposed without being covered by the cover layer 32. By increasing the exposed area of the core member 31 made of the material the thermal conductivity of which is higher than that of the cover layer 32, the heat dissipation from the core member 31 can be increased so that the heat of the core member 31 can be sufficiently dissipated to the outside through the insulator 5. Hence, it is possible to suppress increase of the temperature of the center electrode 2 to thereby prevent the center electrode 2 from expanding excessively with heat.

The cover layer 32 is formed on more than 30% of the surface area of the connecting portion 313. This makes it possible to more suppress the thermal expansion in the axial direction of the center electrode 2.

The area S1 of the lateral periphery of the large-diameter portion 311 and the area S2 of the circumscribed circle of the outer shape of the large-diameter portion 311 when viewed along the axial direction are in the relationship of $S1 \geq 1.5S2$. This makes it possible to further increase the heat dissipation of the center electrode 2.

As described above, the spark plug 1 described above is capable of suppressing the thermal expansion of the center electrode 2 to thereby prevent degradation of the ignition performance.

Validation Test 1

In this test, an amount of the axial expansion of the center electrode 2 of a test sample caused by varying the area of the cover layer 32 formed on the connecting portion 313 of the core member 31 was measured. The shape of the test sample is the same as that of the spark plug 1 according to the first embodiment shown in FIG. 3. Specifically, the diameter D1 of the large-diameter portion 311 is 2.8 mm, the diameter D2 of the small-diameter portion 312 is 1.9 mm, the minimum thickness t of the cover layer 32 is 0.2 mm, and the length L1 between the distal end of the connecting portion 313 and the distal end of the center electrode 2 is 19.0 mm. The outer shape of the cover layer 32 formed on the connecting portion 313 is circular. Varying the area of the cover layer 32 was done by varying the outer diameter of the cover layer 32.

Figure 4:
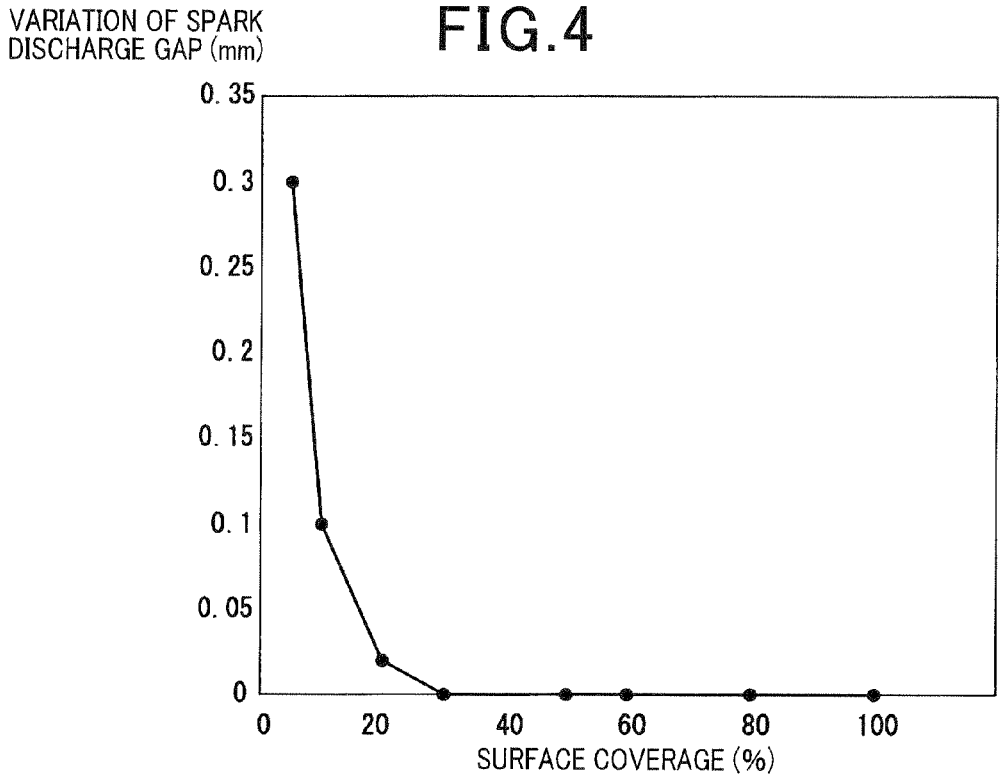
FIG. 4 is a graph showing results of validation test 1 performed on the spark plug according to the first embodiment of the invention.

The results of this validation test are shown in the graph of FIG. 4 in which the vertical axis represents an amount of variation (mm) of the spark discharge gap G at the time of being heated, and the horizontal axis represents the surface coverage (%) of the connecting portion 313. Here, the surface coverage represents the ratio of the area A2 of the cover layer 32 covering the connecting portion 313 to the surface area A1 of the connecting portion 313. As seen from the graph of FIG. 4, the variation in axial length of the spark discharge gap G can be greatly reduced by setting the surface coverage above 30%. Accordingly, by forming the cover layer 32 on more than 30% of the surface area of the connecting portion 32, the variation of the spark discharge gap can be effectively suppressed.

Validation Test 2

In this test, effect of varying the exposed area of the lateral periphery of the large-diameter portion 311 to the heat dissipation of the center electrode 2 of a test sample was evaluated. The shape of the test sample is the same as that of the spark plug 1 according to the first embodiment shown in FIG. 3. Varying the exposed area of the lateral periphery of the large-diameter portion 311 was done by varying the axial length L2 of the large-diameter portion 311.

Figure 5:
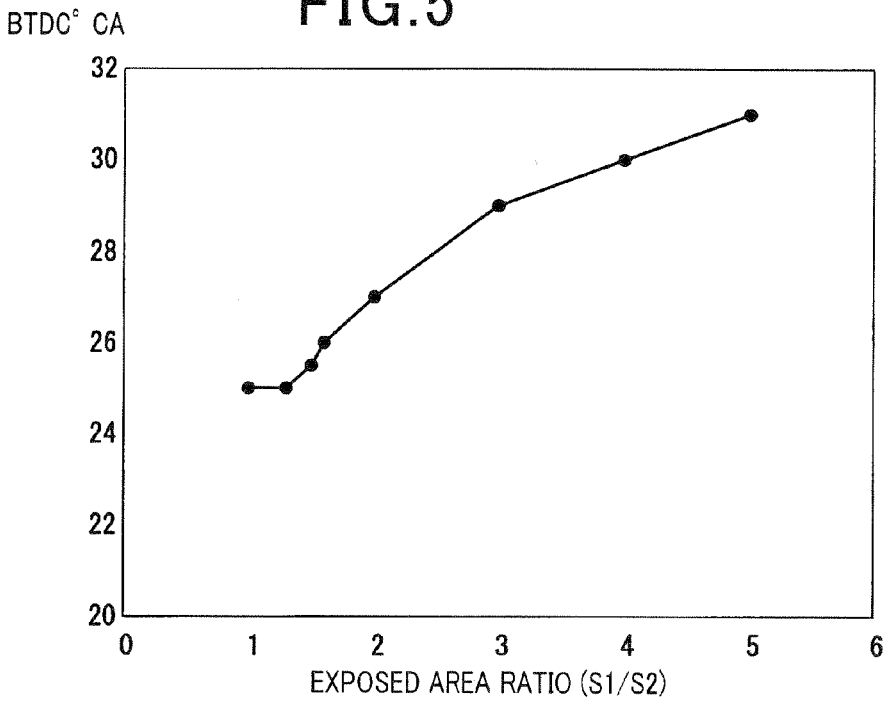
FIG. 5 is a graph showing results of validation test 2 performed on the spark plug according to the first embodiment of the invention.

The results of this validation test are shown in the graph of FIG. 5 in which the vertical axis represents the angle before the top dead center of the crankshaft (BTDC° CA), and the horizontal axis represents the exposed area ratio S1/S2. The effect to the heat dissipation of the center electrode 2 was evaluated by measuring the angle before the top dead center of the crankshaft (BTDC° CA) at the moment of occurrence of preignition. As the angle before the top dead center increases, the combustion temperature increases, and the center electrode 2 receives more amount of heat. Accordingly, as the angle before the top dead center increases, the heat dissipation of the center electrode 2 increases. As explained in the foregoing, the exposed surface ratio S1/S2 is the ratio of the area S1 of the lateral periphery of the large-diameter portion 311 to the area S2 of the circumscribed circle of the outer shape of the large-diameter portion 311 when viewed along the axial direction.

As seen from the graph of FIG. 5, the angle before the top dead center starts to increase when the exposed surface area S1/S2 reaches 1.5. Accordingly, by satisfying the condition of $S1 \geq 1.5S2$, the heat dissipation of the center electrode 2 can be increased.

Second Embodiment

Figure 6:
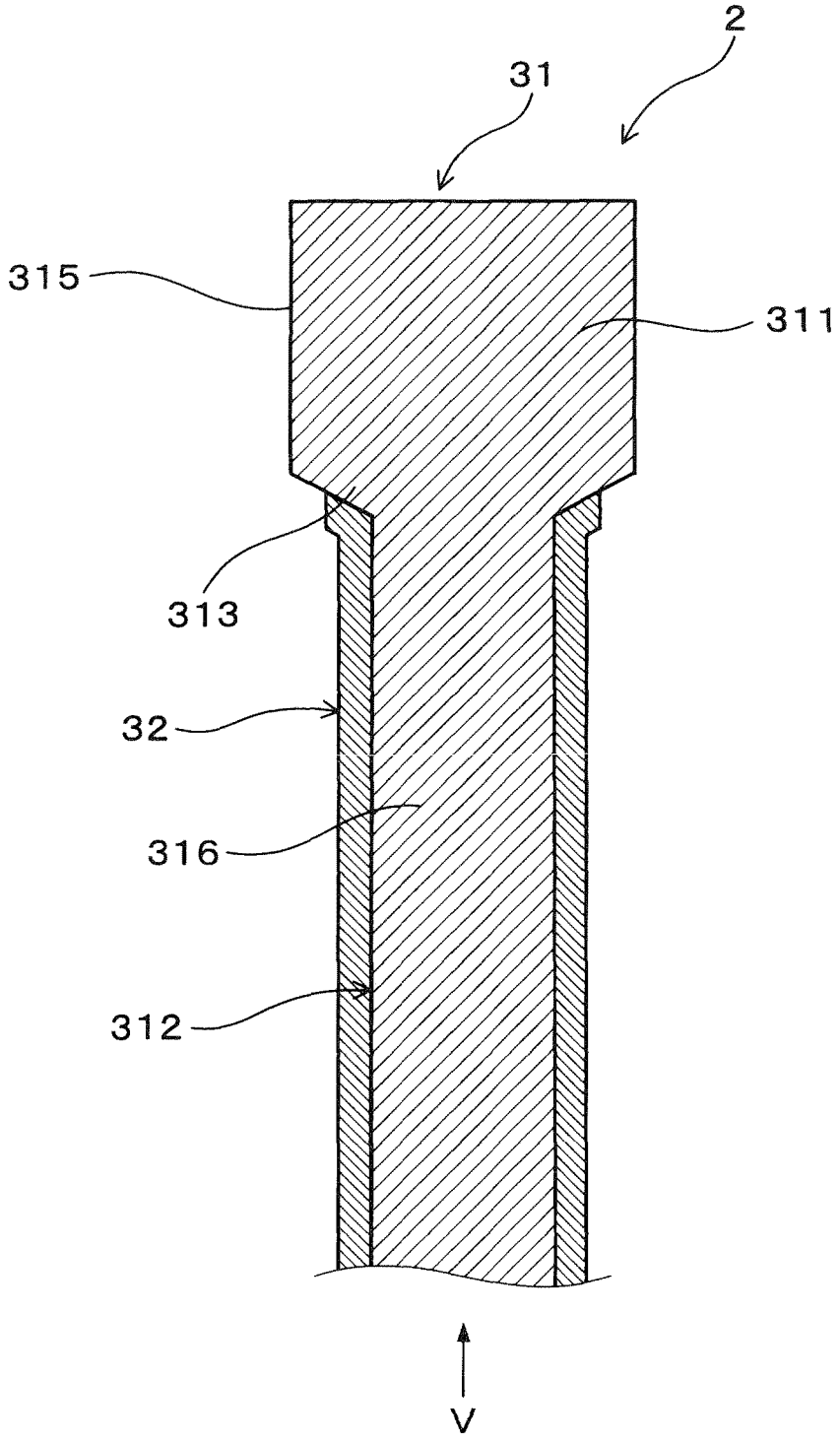
FIG. 6 is a cross-sectional view of a center electrode of a spark plug according to a second embodiment of the invention.
Figure 7:
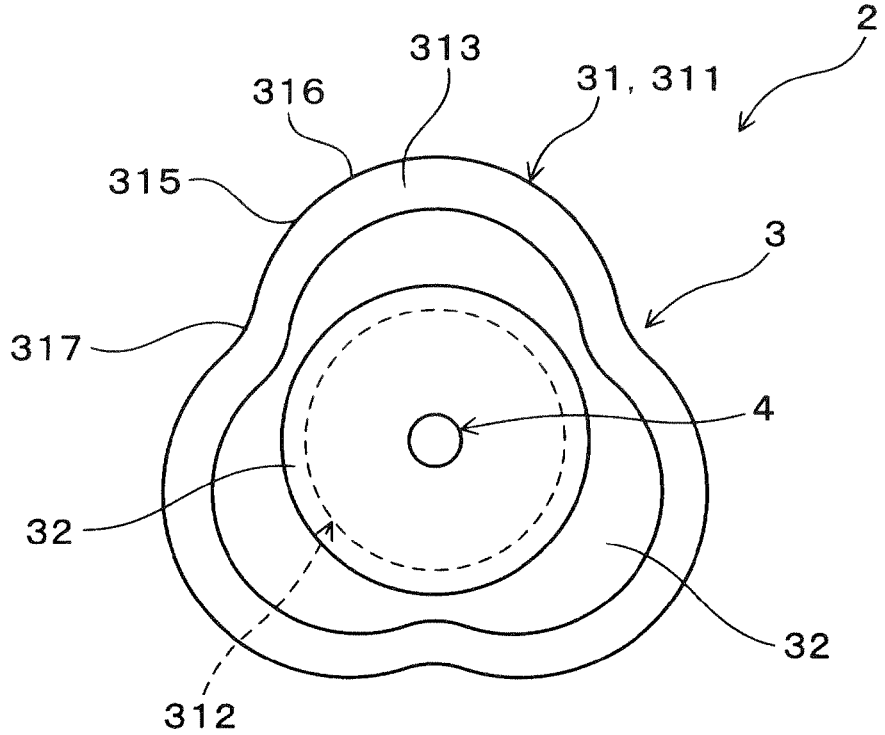
FIG. 7 is a figure viewing from the direction of the arrow V of FIG. 6.

Next, a second embodiment of the invention is described. As shown in FIGS. 6 and 7, the second embodiment differs from the first embodiment in the shape of a part of the spark plug 1. In the second embodiment, the large-diameter portion 311 of the core member 31 of the center electrode 2 has an outer shape constituted of three large arcs 316 projecting radially outward and three small arcs 317 each disposed between adjacent two of the large arcs 316 and projecting radially inward when viewed along the axial direction. In this embodiment, the cover layer 32 is formed in a ring shape on more than 50% of the surface area of the connecting portion 313. The second embodiment provides the same advantages as those provided by the first embodiment.

Third Embodiment

Figure 8:
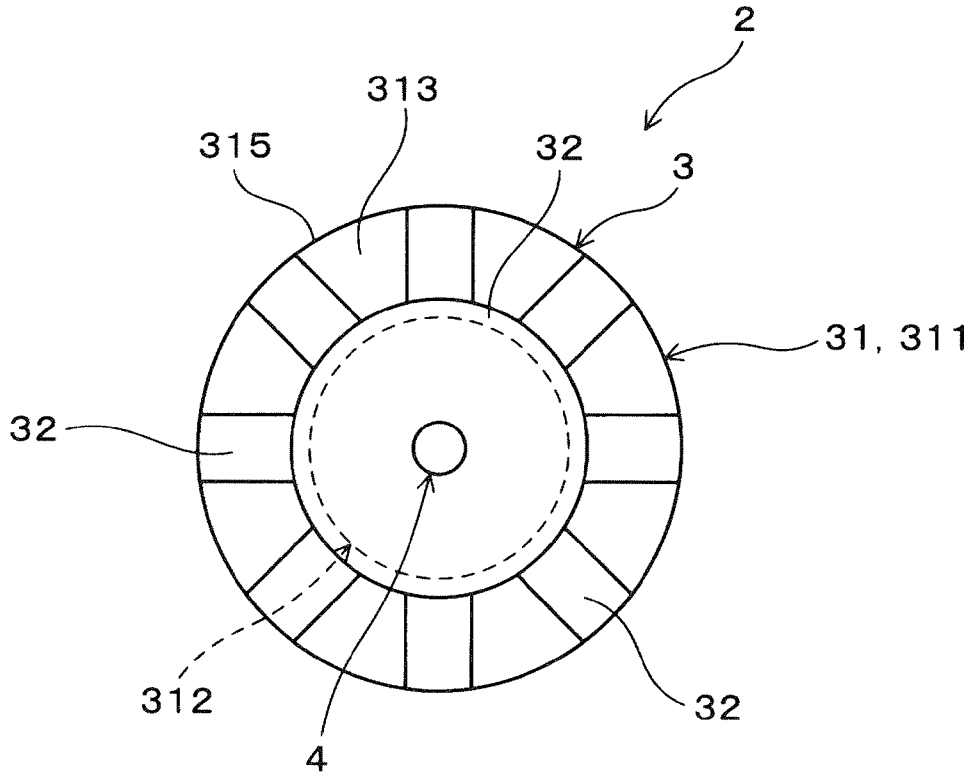
FIG. 8 is a diagram explaining a center electrode of a spark plug according to a third embodiment of the invention.

Next, a third embodiment of the invention is described. As shown in FIG. 8, the third embodiment differs from the first embodiment in the shape of apart of the spark plug 1. In the third embodiment, the cover layer 32 is formed discontinuously in separate parts along the circumferential direction on the surface of the connecting portion 313. The third embodiment provides the same advantages as those provided by the first embodiment.

Figure 9:
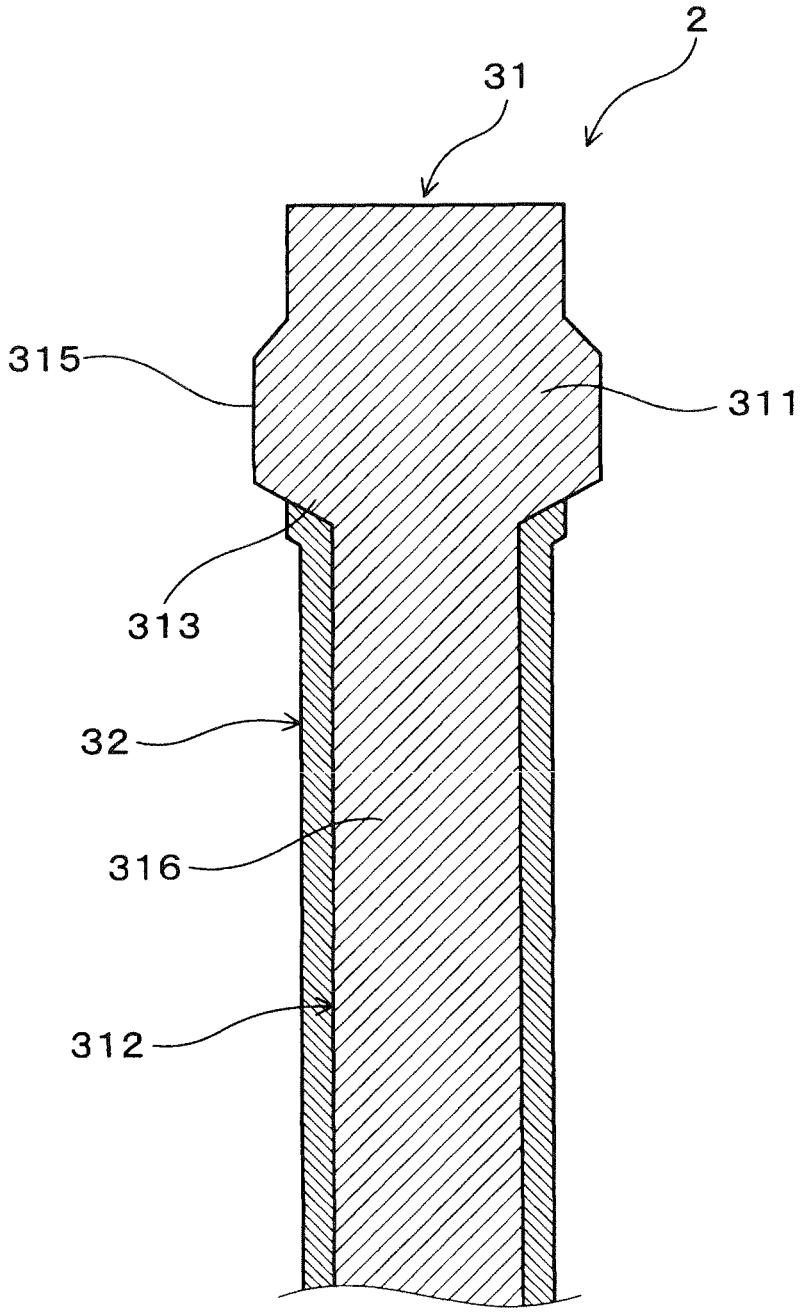
FIG. 9 is a cross-sectional view of a modification of the large-diameter portion of the center electrode of the spark plug according to the embodiments of the invention.

It is a matter of course that various modifications can be made to the above embodiments as described below. In the above embodiments 1 to 3, the large-diameter portion 311 has a uniform cross-sectional shape along the entire axial length thereof. For example, as shown in FIG. 9, the lateral periphery of the large-diameter portion 311 may be partially dented, or its cross-sectional dimension may be partially reduced or enlarged.

The above explained preferred embodiments are exemplary of the invention of the present application which is described solely by the claims appended below. It should be understood that modifications of the preferred embodiments may be made as would occur to one of skill in the art.

What is claimed is:

1. A spark plug for an internal combustion engine comprising:

a center electrode;

an insulator holding the center electrode inserted thereinto;

a housing holding the insulator inserted thereinto in a state that an proximal end portion of the insulator is exposed from the housing; and a ground electrode joined to the housing so as to form a spark discharge gap with the center electrode;

wherein the center electrode includes a core member having a bar shape and a cover layer covering a surface of the core member, the core member includes a large-diameter portion made of a material having a thermal conductivity higher than a thermal conductivity of the cover layer, a small-diameter portion which is smaller in diameter than the large-diameter portion and extends from the large-diameter portion in an axial direction of the core member toward a distal end side of the core member, and a connecting portion formed so as to connect the large-diameter portion to the small-diameter portion, the cover layer is made of a material having a linear expansion coefficient lower than a linear expansion coefficient of the core member, and covers between at least part of the connecting portion and a distal end of the small-diameter portion, and a surface of the large-diameter portion is exposed without being covered by the cover layer.

2. The spark plug for an internal combustion engine according to claim 1, wherein the cover layer is formed on 30% or more of a surface area of the connecting portion.

3. The spark plug for an internal combustion engine according to claim 1, wherein, when an area of a lateral periphery of the large-diameter portion is S1 and an area of a circumscribed circle of an outer shape of the large-diameter portion when viewed along the axial direction is S2, a relationship of $S1 \geq 1.5S2$ is satisfied.

* * * * *